United States Patent [19]

Latina

[11] 4,192,018

[45] Mar. 11, 1980

[54] BASEBALL GLOVE

[75] Inventor: Roland N. Latina, Belleville, Ill.

[73] Assignee: A-T-O Inc., Willoughby, Ohio

[21] Appl. No.: 896,293

[22] Filed: Apr. 14, 1978

[51] Int. Cl.² ..... A41D 13/10

[52] U.S. Cl. ..... 2/19

[58] Field of Search ..... 2/19, 158

[56] References Cited

U.S. PATENT DOCUMENTS

| | | | |
|---|---|---|---|
| 528,343 | 10/1894 | Rogers | 2/19 |
| 1,552,080 | 9/1925 | Rainey | 2/19 |
| 3,602,915 | 9/1971 | Collins | 2/19 |
| 3,623,163 | 11/1971 | Latina | 2/19 |

*Primary Examiner*—Dorsey Newton

*Attorney, Agent, or Firm*—Senniger, Powers, Leavitt and Roedel

[57] ABSTRACT

A baseball glove having a thumb and finger stalls, a crotch portion between the base of the thumb stall and the base of the next adjacent finger stall, and a web extending between and being secured to the thumb and next adjaent finger stall and to the crotch portion. The web has a series of spaced lacing loops or tunnels at its margin, and the inner margins of the thumb and next adjacent finger stalls and the margin of the crotch portion also have a series of spaced lacing loops or tunnels alternating with and being generally in line with the web tunnels so that a lace may be passed through the tunnels for securing the web to the glove.

6 Claims, 8 Drawing Figures

BASEBALL GLOVE

BACKGROUND OF THE INVENTION

This invention relates to a baseball glove or mitt, and more particularly to the construction of the web or backstop of the glove and the manner in which the web is secured to the glove.

In baseball gloves of modern construction, the glove is typically substantially larger than the player's hand with the thumb and finger stalls of the glove extending well beyond the end of the player's thumb and fingers. As is conventional, a web or backstop bridges the space between the thumb stall and the index finger stall. This web is intended to form a pocket in which the ball is normally caught. As disclosed in the co-assigned U.S. Pat. Nos. 3,321,771, 3,588,915 and 3,623,163, the web may be concave so that it forms a continuation of a pocket formed in the palm portion of the glove.

This invention is concerned with an improvement in the joinder of the web and the glove proper, whereby a ball which first contacts the glove on the front face of the finger or thumb stalls or on the pocket in the palm of the glove will automatically either be guided into the ball retaining pocket of the web or will be retained in the glove pocket in the palm of the glove.

Reference may also be made to such U.S. Pat. Nos. as 528,343, 1,473,849, 1,552,080, and 3,909,848 in the prior art.

SUMMARY OF THE INVENTION

Among the several objects and features of this invention may be noted the provision of a baseball glove or mitt having a web secured to the crotch, thumb stall, and finger stall of the glove with a relatively smooth transition into the web; the provision of such a glove in which the web is concave to provide a ball retention pocket; the provision of such a glove in which the web may be more readily laced to the glove to reduce the labor involved in manufacturing the glove; the provision of such a glove which is flexible so as to enable a player to control the glove; and the provision of a glove which has a pleasing appearance.

Briefly, a baseball glove of this invention has a thumb stall, a finger stall spaced from the thumb stall, a crotch portion between the thumb and finger stalls, a front ply constituting the front face of the glove, a back ply constituting the back face of the glove, and a web secured to and extending between the thumb and finger stalls. The web has a plurality of spaced tunnels at its margins contiguous to the inwardly facing margins of the thumb and finger stalls and the margin of crotch portion. The finger and thumb stalls and the crotch portion have a plurality of spaced tunnels extending toward the web from the previously-mentioned inwardly facing margins of the thumb and finger stalls and the margin of the crotch portion with these last-mentioned tunnels being referred to as glove tunnels. The glove tunnels and the web tunnels are interdigitated, i.e., they alternate with one another and are generally in line with one another. A lace is passed through the glove and web tunnels to secure the web to the glove.

Other objects and features of this invention will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
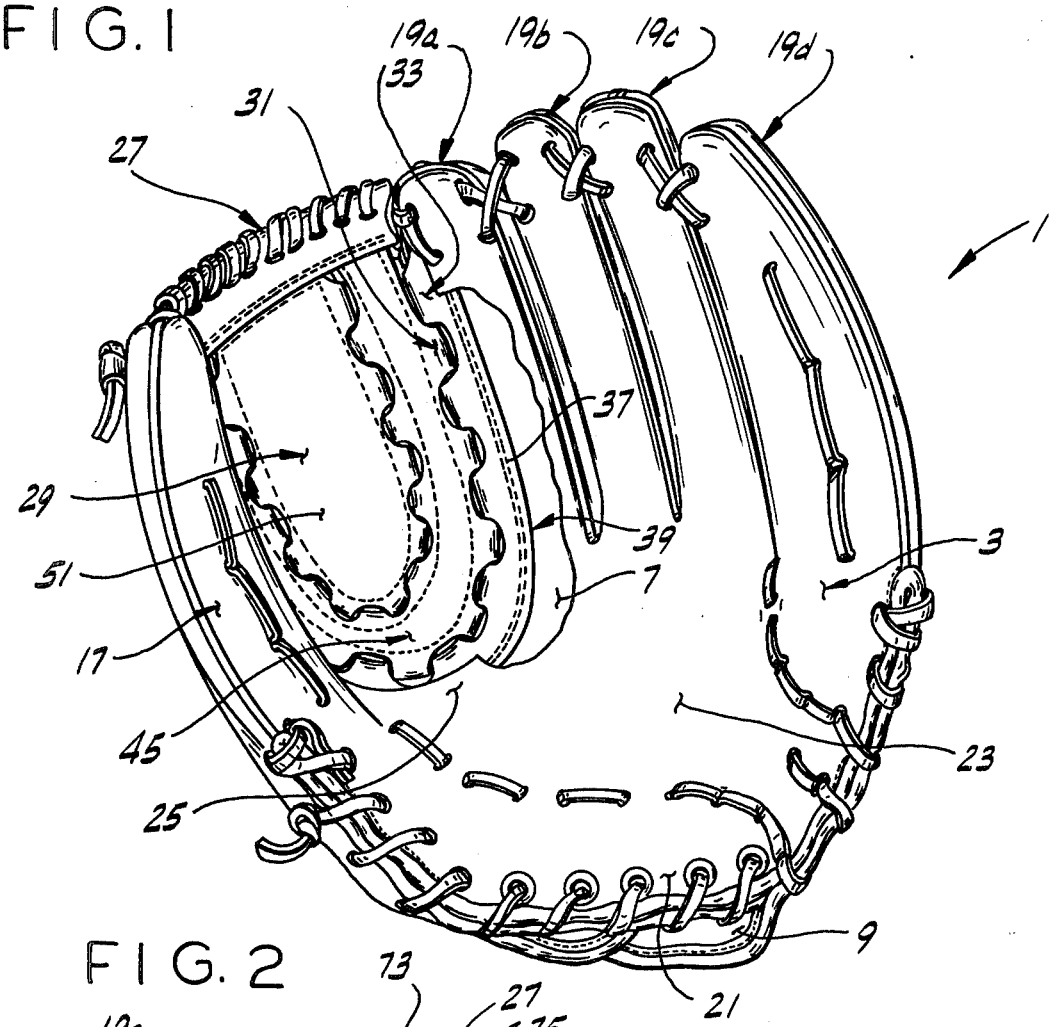
FIG. 1 is a front perspective view of a baseball glove of this invention having a web between its thumb and index finger stalls secured to the glove by means of a lace passing through interdigitated lacing loops or tunnels provided on the glove and on the web.
Figure 2:
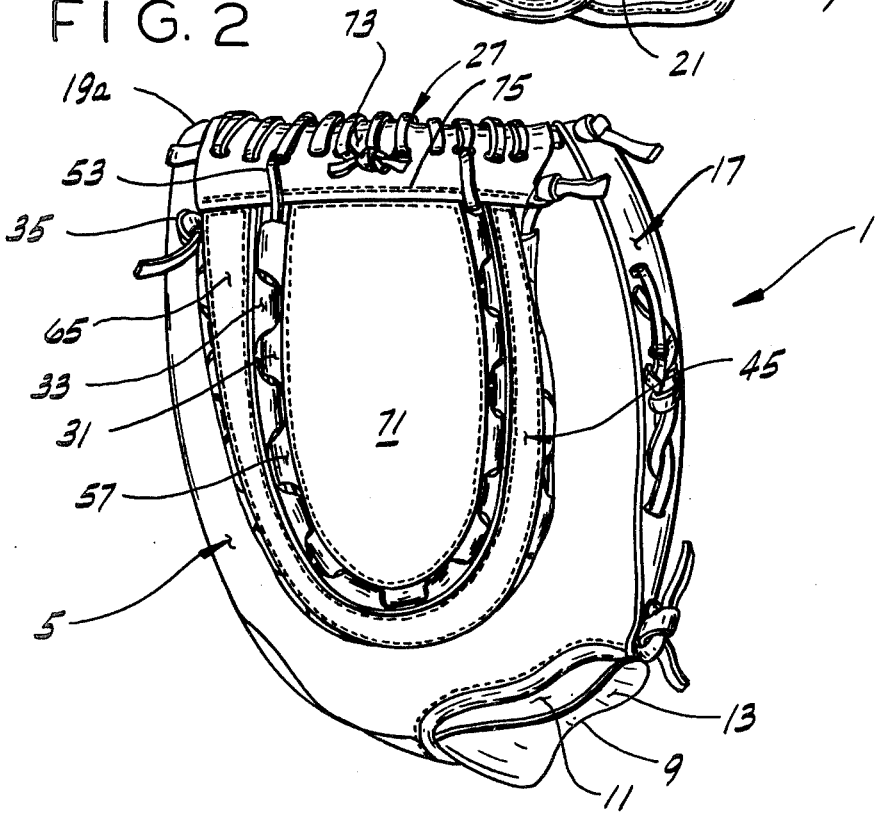
FIG. 2 is a perspective view of the back of the glove and the web.

Referring now to the drawings, a baseball glove of the present invention is indicated in its entirety at 1. As is conventional, the glove is made of leather, although it may be made of other suitable limp sheet material. The glove includes a front or palm ply 3 constituting the front face of the glove and a back ply 5 constituting the back face of the glove. At 7 (see FIG. 1) is indicated a lining for the glove, and at 9 is indicated a hand receiving opening at the bottom of the glove, where the player inserts his hand. The lining 7 may itself be in the form of a glove, received in the outer shell of the glove formed by plies 3 and 5. The back ply of the glove is split at 11 and has a tab 13 extending across the split. The tab and the back ply are provided with hook and pile fastening means (not shown) so that the back face of the glove may be readily drawn up on the player's hand as desired by the player.

The glove further includes a thumb stall 17 which at least partially receives the wearer's thumb, and a plurality of finger stalls **19*a*–19*d* into which the wearer's fingers are at least partially inserted, one finger in each finger stall. It will be understood, however, that in certain glove or mitt designs of the invention, two or more or even all of the player's fingers may be inserted in a single stall. As shown in FIG. 1, a portion of the front face of the glove between the base of the finger stalls and the heel 21 of the glove is concave to form a body ball receiving pocket 23. The portion of the glove between the base of the thumbstall and the next adjacent finger stall 19*a* (i.e., the index finger stall) is referred to as the crotch portion and numbered 25**.

Glove 1 is shown further to comprise a web or backstop, generally indicated at 27, secured to the inwardly facing portions or margins of thumb stall 17 and the next adjacent finger stall **19*a* and the margin of crotch portion 25, with a relatively smooth transition between the front plane or surface of the finger stalls and the web, between the front plane or surface of the thumb stall and the web and between the front concave face of body pocket 23 and the web. The latter is concave so that its center portion is recessed relative to the thumb and finger stalls and relative to body pocket 23, forming a ball retaining pocket 29** in the web.

Figure 3:
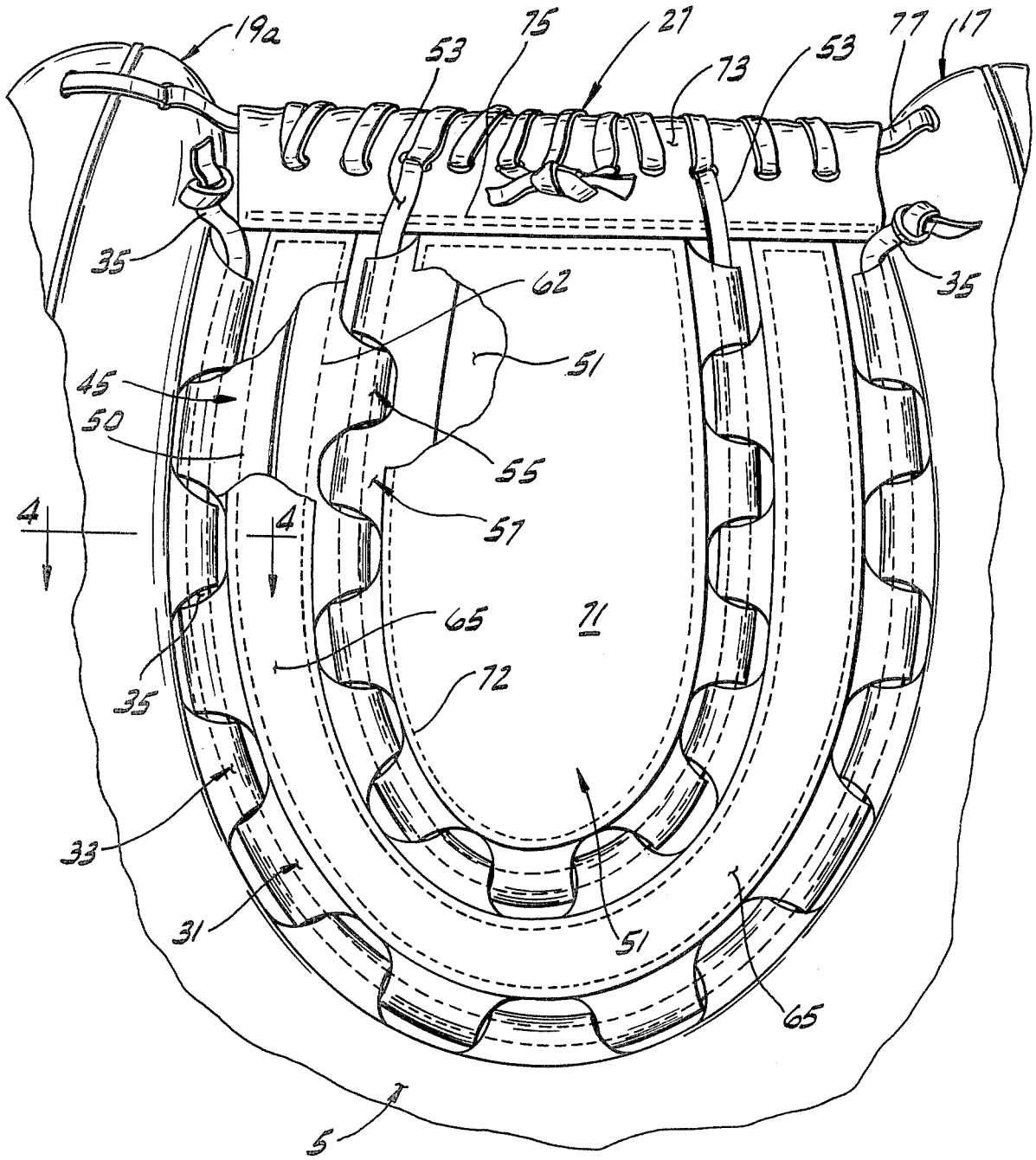
FIG. 3 is an enlarged rear elevational view of the web as it is secured to the glove.
Figure 5:
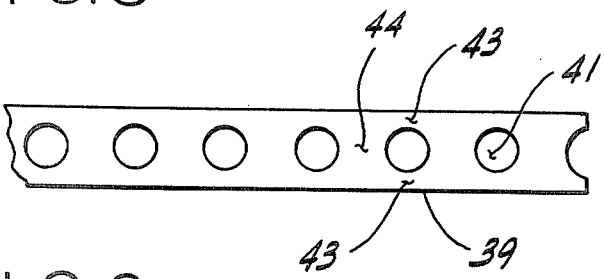
FIG. 5 is a portion of a flat pattern layout of a strip constituting a part of the glove.

As shown in FIGS. 1, 3 and 5, a series of spaced lacing loops or tunnels 31 is provided on web 27. These web tunnels are formed on the margins or sides of the web which are contiguous to the inwardly facing margins of thumb stall 17 and finger stall 19*a* and the margin of crotch portion 25, the front faces of the web tunnels being generally coplanar with the concave front face of the web so as to result in the above-mentioned smooth transition from the glove to the web. As indicated at 33, a series of lacing loops or tunnels (referred to as glove tunnels) is provided on the glove extending inwardly toward the web from the above-mentioned inwardly facing margins of thumb stall 17 and finger stall 19*a*, and the margin of crotch portion 25, the front face of these glove tunnels along the finger stall 19*a* being generally coplanar with the front face of the finger stalls (see FIG. 4) and the front face of the glove tunnels along the thumb stall being generally coplanar with the front face of the thumb stall, and the glove tunnels along the crotch portion being a smooth extension of the concave front face of pocket 23. This results in the above-mentioned smooth transition from the glove to the web.

Further in accordance with this invention, web tunnels 31 and glove tunnels 33 are interdigitated, i.e., they are generally in line with one another (coaxial) and alternate with one another so that a first lace 35 (see FIG. 3) may be passed through all of the glove and web tunnels thereby to secure the web to the glove. Lace 35 is shown to be tied to the outer ends of thumb stall 17 and finger stall 19*a*. With the web and glove tunnels alternating with one another, and with the spaces between the glove and web tunnels sized to receive a tunnel of the opposite member, the tunnels are substantially contiguous around the margin of the webs, and yet allow a high degree of movement of the web and the glove so that the player can readily control the glove, and so the web can readily conform to the ball when the ball enters the web. Thus, the web of the glove of this invention has good ability to retain balls entering the web from a variety of angles and enhances the ability of the player to make catches.

Figure 6:
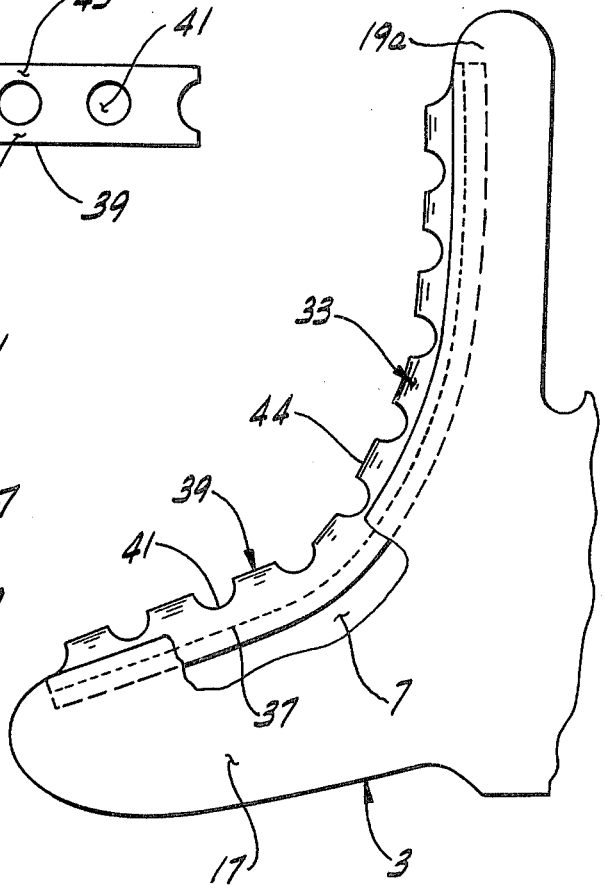
FIG. 6 is a flat pattern layout of a portion of the front or palm ply of the glove with the strip shown in FIG. 5 folded double and stitched to the inwardly facing margins of the palm ply so as to form a series of loops or tunnels, referred to as glove tunnels.
Figure 4:
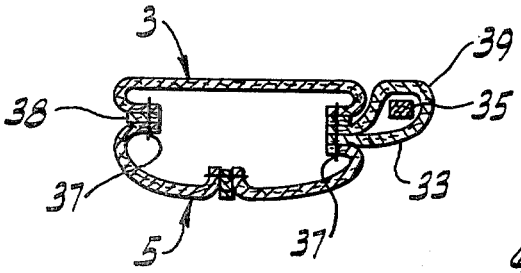
FIG. 4 is an enlarged cross sectional view of the index finger stall with the thickness of the various plies exaggerated and with certain plies and padding material having been omitted for purposes of clarity.

In detail, front ply 3 and back ply 5 are sewn together along a seam 37 (see FIGS. 1 and 4) at the side and ends of thumb stall 17 and finger stalls 19*a*–19*d* to form the thumb stall, crotch portion 25, and the finger stalls. Welting is indicated at 38 in FIG. 4. The lining is omitted in FIG. 4. The glove further comprises a strip 39 which is shown in flat pattern in FIG. 5. This strip has a series of substantially equally spaced holes 41 therethrough. The portion of the strip between the outer edges of the strip and each of the holes is indicated at 43. The series of holes is shown to be substantially centered on the longitudinal centerline of the strip and the holes are equally spaced from one another with portions 44 of the strip between the holes being of substantially equal length. The strip is folded double along its longitudinal centerline so that portions 44 form the glove tunnels 33 and so that holes 41 constitute gaps or spaces between the glove tunnels for receiving the web tunnels 31. Of course, holes 41 (and hence the above-mentioned gaps) are sized so as to receive the web tunnels. With strip 39 folded double (as shown in FIGS. 4 and 6), the double-folded faces of the strip are sewn to the front and back plies 3 and 5 along the inwardly facing margins of thumb stall 17 and finger stall 19*a* and the margin of crotch portion 25 by stitching constituting seam 37. Thus, the double-folded portions 44 of the strip which constitute glove tunnels 33 project inwardly toward the web.

As best shown in FIG. 1, web 27 includes a U-shaped peripheral member 45 extending along the margins of the web adjacent the inwardly facing margins of finger stall 19*a* and thumb stall 17 and the margin of crotch portion 25. As shown in its flat pattern layout (FIG. 7), the peripheral member has a first series of equally spaced holes 47 therethrough extending along a first curvilinear centerline 48. These holes are spaced substantially equidistantly from one another with substantially equal length portions 49 of the peripheral member therebetween. The outer margin of the peripheral member is folded double on itself along the first curvilinear centerline 48 so that portions 49 form web tunnels 31 and so that holes 47 form spaces or gaps between the web tunnels for receiving glove tunnels 33. The outer margin of the peripheral member is stitched to itself while in its above-mentioned double-folded condition along a line of stitching 50.

Figure 7:
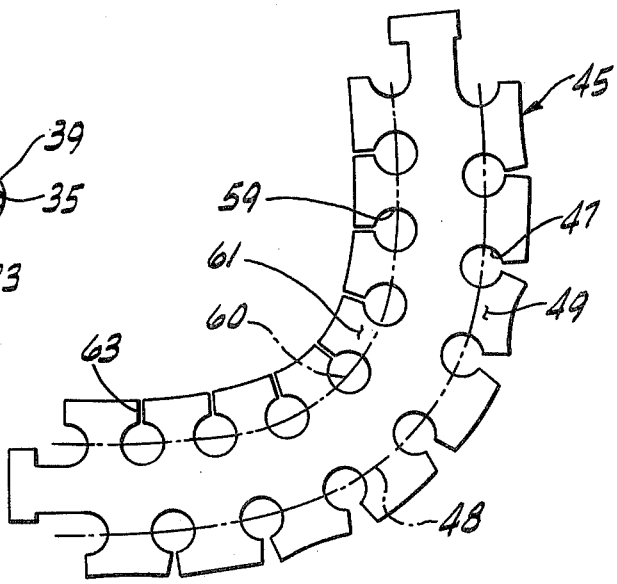
FIG. 7 is a flat pattern layout of a peripheral member of the web of the glove.

Web 27 further includes an inner web member 51 secured to peripheral member 45 by a second lace 53 which passes through alternating inwardly facing loops or tunnels 55 formed on peripheral member 45 and through outwardly projecting loops or tunnels 57 formed on the inner web member (see FIG. 3). Inner web member 51 is generally U-shaped and has a concave pocket therein. As shown in FIG. 7, peripheral member 45 has a second series of holes 59 therethrough spaced substantially equidistantly from one another and centered on a second curvilinear centerline 60 generally parallel to curvilinear centerline 48 with substantially equal length portions 61 of the peripheral member between holes 59. The peripheral member is folded double on the second curvilinear centerline and is stitched together, as indicated at 62 in FIG. 3, so that portions 61 form inner peripheral member tunnels 55 with holes 49 constituting spaces therebetween. As shown in FIG. 7, peripheral member 45 has a plurality of slits 63, one for each hole 59, in the portion thereof between its inner edge and each hole 59 so as to enable the peripheral member to stretch or expand as the inner margin of the peripheral member is folded double. A reinforcing strip 65 (see FIG. 3) is sewn to the back of the peripheral member by stitching lines 50 and 62, thereby to reinforce the peripheral member and to give a substantially smooth and continuous finish surface to the back of the web.

Figure 8:
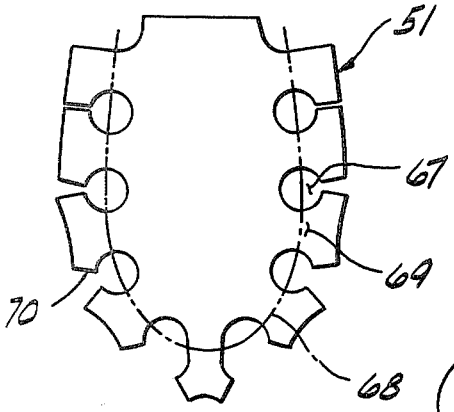
FIG. 8 is a flat pattern layout of the inner portion of the web.

As shown in FIG. 8, inner web member 51 is generally a flat, U-shaped member having a series of equally spaced holes 67 centered on a curvilinear centerline 68 adjacent its outer margin with substantially equal portions 69 of the inner web member therebetween. As indicated at 70, the inner web member is slit to enable the outer margin of the inner web member to be folded back on itself along this curvilinear centerline 68 so that portions 69 form inner web member tunnels 57 and so that holes 67 form gaps or spaces between these tunnels for receiving the inwardly projecting tunnels 55 of peripheral member 45. As shown in FIG. 3, a reinforcing member 71 is sewn to the back of the inner web member by the same line of stitching 72 which secures the double folded margins of the inner web member together. Thus, reinforcing member 71 reinforces the inner web member and provides a continuous, finished surface to the back of the inner web member. A hem 73 is folded over the outer ends of peripheral member 45 and the outer end of inner web member 51 and sewn thereto along double lines of stitching 75 so as to form an elongate tunnel. A third lace 77 is passed through this tunnel and is tied to the outer ends of thumb stall 17 and finger stall 19*a* so as to support the outer ends of the web.

In view of the above it will be seen that the several objects of the invention are achieved and other advantageous results attained.

As various changes could be made in the above constructions without departing from the scope of the invention, it is intended that all matter contained in the above-described specification and in the accompanying drawings should be interpreted as illustrative and not in a limiting sense.

What is claimed is:

1. A baseball glove or the like having a thumb stall, a finger stall spaced from the thumb stall, a crotch portion between the thumb and finger stalls, a front ply constituting the front face of the glove, a back ply constituting the back face of the glove, the front and back plies being joined together by a seam extending along the inner margins of the thumb and finger stalls and the margin of the crotch portion, and a web secured to and extending between said thumb and finger stalls, said web having a plurality of spaced tunnels at its margins contiguous to the inner margins of the thumb and finger stalls and the margin of the crotch portion, the finger and thumb stalls and said crotch portion having a plurality of spaced glove tunnels extending toward the web from the inner margins of the thumb and said finger stalls and the margin of the crotch portion, said glove tunnels and said web tunnels alternating with one another and being generally in line with one another, the glove further comprising a lace passing through the glove and the web tunnels for securing said web thereto, a strip having a series of holes therethrough substantially centered on the central longitudinal axis of the strip and substantially equidistant from one another along the length of the strip with substantially equal portions of the strip between said holes, the strip being folded double on said longitudinal axis and having its overlapped faces secured to said front and back plies along seam joining the front and back plies so that the folded edge of the strip projects inwardly toward the web with the double-folded portions of the strip between the holes therein constituting said glove tunnels, and said web comprising an inner web member and a separate generally U-shaped peripheral member having an inner margin attached to the inner web member along the outer margin of the inner web member, and an outer margin adjacent said inner margins of said finger and thumb stalls and the margin of said crotch portion, the outer margin of the peripheral member having a first series of holes therein spaced substantially equidistantly from one another along a first generally curvilinear line with substantially equal portions of said peripheral member between each of said holes, the outer margin of the peripheral member being folded double on said first curvilinear line and having said double-folded portions secured together whereby said portions of said peripheral member between said first series of holes constitute said web tunnels.

2. A glove as set forth in claim 1 wherein said holes in said strip and said holes in said peripheral member are circular holes of substantially the same diameter and wherein said portions of said strip and of said peripheral member between said holes are substantially the same length so that a tunnel of either said strip or of said peripheral member will fit closely within a gap formed by said hole between adjacent tunnels of the other member.

3. A glove as set forth in claim 1 wherein said web has a hem at its outer end extending generally between the outer end of said thumb stall and said finger stall, a second lace extending through said hem and being secured to said thumb and finger stalls thereby to support the outer end of the web.

4. A glove as set forth in claim 1 wherein the face of said strip constituting the front face of said glove tunnels is generally coplanar with the front face of said thumb and said finger stalls and with said crotch portion so that there is a substantially smooth transition between said finger and thumb stalls and said web and between said crotch portion and said web.

5. A baseball glove or the like having a thumb stall, a finger stall spaced from the thumb stall, a crotch portion between the thumb and finger stalls, a front ply constituting the front face of the glove, a back ply constituting the back face of the glove, the front and back plies being joined together by a seam extending along the inner margins of the thumb and finger stalls and the margin of the crotch portion, and a web secured to and extending between said thumb and finger stalls, said web having a plurality of spaced tunnels at its margins contiguous to the inner margins of the thumb and finger stalls and the margin of the crotch portion, the finger and thumb stalls and the crotch portion having a plurality of spaced glove tunnels extending toward the web from the inner margins of the thumb and finger stalls and the margin of the crotch portion, said glove tunnels and said web tunnels alternating with one another and being generally in line with one another, the glove further comprising a lace passing through the glove and the web tunnels for securing said web thereto, a strip having a series of holes therethough substantially centered on the central longitudinal axis of the strip and substantially equidistant from one another along the length of the strip with substantially equal portions of the strip between said holes, the strip being folded double on said longitudinal axis and having its overlapped faces secured to said front and back plies along said seam joining the front and back plies so that the folded edge of the strip projects inwardly toward the web with the double-folded portions of the strip between the holes therein constituting said glove tunnels, said web comprising a generally U-shaped peripheral member extending along the margins of the web adjacent the inner margins of the finger and thumb stalls and the margin of the crotch portion, said peripheral member having a first series of holes therein spaced substantially equidistantly from one another along a first generally curvilinear line with substantially equal portions of the peripheral member between each of said holes, the peripheral member being folded double on said first curvilinear line and having said double-folded portions secured together whereby the portions of said peripheral member between the first series of holes constitute said web tunnels, and the web further comprising an inner web member secured to the inner margin of the peripheral member for forming a recessed pocket, the peripheral member having a second series of holes therein spaced equidistantly from one another along a second curvilinear line generally parallel to said first curvilinear line, the peripheral member being folded double on the second curvilinear line thereby to form a series of inner peripheral member tunnels, the inner web member having a series of holes therein spaced equidistantly from one another along a curvilinear line adjacent the outer margin of said inner web member, the outer margin of the inner web member being folded double on the last-mentioned curvilinear line and being secured to the inner web member to form a series of spaced inner web member tunnels, the latter fitting between and alternating with said inner peripheral member tunnels, the glove further comprising a third lace passing through the inner peripheral member tunnels and the inner web member tunnels thereby to secure the inner web member to the peripheral member.

6. A glove as set forth in claim 5 wherein the portion of said peripheral member between the edge of said peripheral member and at least some of the holes constituting said second series of holes is split, said web further comprising a reinforcing strip sewn on the backside of said peripheral member overlying the margin of said peripheral member folded double on itself along said second curvilinear line thereby to reinforce said peripheral member.

* * * * *

UNITED STATES PATENT AND TRADEMARK OFFICE

CERTIFICATE OF CORRECTION

PATENT NO. : 4,192,018

DATED : March 11, 1980

INVENTOR(S) : Roland N. Latina

It is certified that error appears in the above-identified patent and that said Letters Patent are hereby corrected as shown below:

In the Abstract, line 5, "adjaent" should read -- adjacent --.
Column 5, line 45, "along seam" should read -- along said seam -

Signed and Sealed this

*Tenth* Day of *June 1980*

[SEAL]

*Attest:*

SIDNEY A. DIAMOND

*Attesting Officer*

*Commissioner of Patents and Trademarks*